US010471720B2

(12) United States Patent
Gaston Llado et al.

(10) Patent No.: US 10,471,720 B2
(45) Date of Patent: Nov. 12, 2019

(54) PRINTHEAD-WIPING DEVICE

(71) Applicant: Hewlett-Packard Development Comapny, L.P., Houston, TX (US)

(72) Inventors: Gonzalo Gaston Llado, Barcelona (ES); Ana Cristina Garcia Alvarez, Sant Cugat del Valles (ES); Marta Coma Vives, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/764,004

(22) PCT Filed: Jan. 29, 2016

(86) PCT No.: PCT/EP2016/051999

§ 371 (c)(1),
(2) Date: Mar. 28, 2018

(87) PCT Pub. No.: WO2017/129267

PCT Pub. Date: Aug. 3, 2017

(65) Prior Publication Data

US 2018/0281418 A1 Oct. 4, 2018

(51) Int. Cl.
*B41J 2/165* (2006.01)

(52) U.S. Cl.
CPC ..... *B41J 2/16544* (2013.01); *B41J 2/16535* (2013.01); *B41J 2/16538* (2013.01); *B41J 2002/16573* (2013.01)

(58) Field of Classification Search
CPC ..... B41J 2/16541; B41J 2/16544; B41J 2/16535; B41J 2/16538
USPC ..... 347/22, 33
See application file for complete search history.

(56) References Cited

U.S. PATENT DOCUMENTS

| | | | | |
|---|---|---|---|---|
| 5,640,182 | A | 6/1997 | Bahrami et al. | |
| 5,724,078 | A | 3/1998 | Kotaki | |
| 5,786,830 | A | 7/1998 | Su et al. | |
| 6,151,044 | A * | 11/2000 | Gaasch | B41J 2/16544 347/33 |
| 6,641,245 | B1 | 11/2003 | Kelly et al. | |
| 8,160,467 | B2 | 4/2012 | Zona et al. | |
| 8,894,180 | B2 * | 11/2014 | O'Hara | B41J 2/16585 347/22 |
| 2005/0007411 | A1 | 1/2005 | Tee et al. | |

(Continued)

FOREIGN PATENT DOCUMENTS

| | | |
|---|---|---|
| CN | 101054022 | 10/2007 |
| EP | 1520704 | 6/2005 |
| EP | 2783876 | 10/2014 |

OTHER PUBLICATIONS

Craden, "Maintenance", Available at: http://www.craden.com/Site/images/Tk10maint.pdf.

*Primary Examiner* — An H Do
(74) *Attorney, Agent, or Firm* — HP Inc. Patent Department

(57) ABSTRACT

In an example, a printhead-wiping device comprises: a wiper element and a biasing mechanism, the biasing mechanism to bias the wiper element towards a printhead. An actuator may be used to adjust a preload force applied to the biasing mechanism. The preload force applied to the biasing mechanism may be controlled using a controller so as to control a wiping force applied by the wiper element against the printhead.

20 Claims, 5 Drawing Sheets

(56) References Cited

U.S. PATENT DOCUMENTS

| | | | |
|---|---|---|---|
| 2006/0066665 | A1 | 3/2006 | Kachi et al. |
| 2008/0018677 | A1 | 1/2008 | White et al. |
| 2008/0266342 | A1 | 10/2008 | Steinfield et al. |

* cited by examiner

PRINTHEAD-WIPING DEVICE

BACKGROUND

A print device may be provided with a cleaning unit for cleaning a printhead of the print device. The cleaning unit may comprise a wiper blade which is drawn across the surface of the printhead to clean the printhead.

BRIEF DESCRIPTION OF DRAWINGS

Non-limiting examples will now be described, with reference to the accompanying drawings, in which.

DETAILED DESCRIPTION

Figure 1:
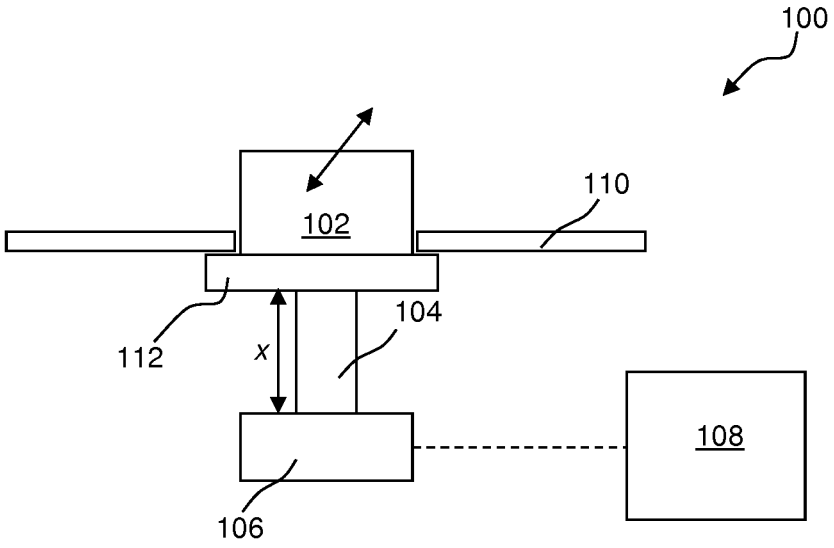
FIG. 1 is an example schematic view of an example printhead-wiping device in a first configuration.

FIG. 1 is a schematic representation of an example of a printhead-wiping device 100 comprising a wiper element 102 which may be in the form of a rigid or flexible wiper blade. The printhead-wiping device 100 may be installed in a print device such that a printhead (not shown) of the print device can be brought into contact with the wiper element 102 during a cleaning operation, as described further below. As indicated by the arrow in FIG. 1, the printhead-wiping device 100 performs a longitudinal wiping action across the printhead; however, in other examples, a transverse wiping action may be used.

The wiper element 102 is supported by a biasing mechanism 104. The biasing mechanism 104 biases the wiper element 102 outwardly towards the printhead. The biasing mechanism 104 is in turn supported by an actuator 106 which is in communication with a controller 108 through either a wired or wireless connection and/or a mechanical interface.

The wiper element 102 may be received within an opening in a casing 110 of the printhead-wiping device 100. The wiper element 102 may be retained within the printhead-wiping device 100 via a base portion 112 which has dimensions that are larger than the opening and thus holds the wiper element 102 within the opening.

In this example, the biasing mechanism 104 is resiliently compressible along its axis such that upon compression of the biasing mechanism 104 it generates a restoring force which acts to force the wiper element 102 outwards.

The biasing mechanism 104 is supported by a movable portion of the actuator 106. The movable portion is movable towards and away from the casing 110 of the printhead-wiping device so as to reduce the distance between the movable portion and the casing 110.

Figure 2:
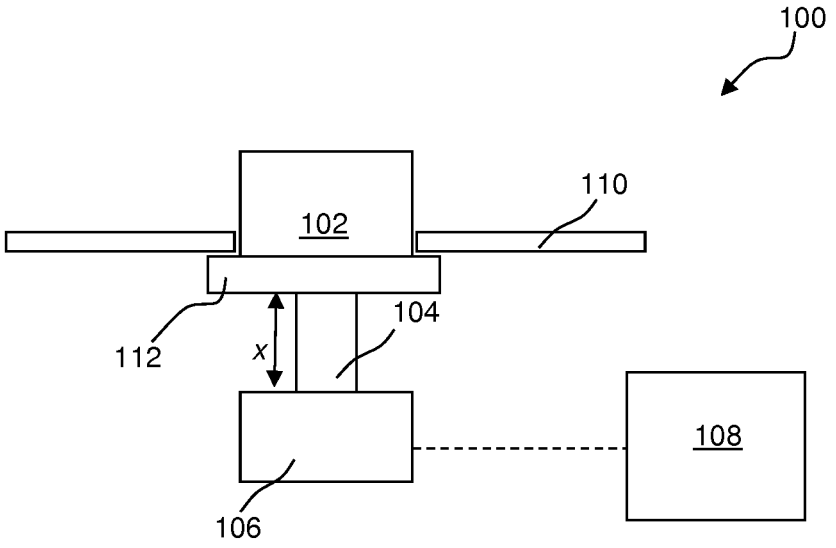
FIG. 2 shows the printhead-wiping device of FIG. 1 in a second configuration.

As shown in FIG. 2, movement of the movable portion of the actuator 106 toward the casing 110 reduces the distance between the movable portion and the base portion 110 of the wiper element 102. Consequently, the biasing mechanism 104 is compressed, reducing an axial length x of the biasing mechanism 104. The compression of the biasing mechanism 104 generates a preload force within the biasing mechanism 104. This preload force dictates a wiping force applied by the wiper element 102 against the printhead during the cleaning operation.

For a rigid wiper element, the wiping force may be determined by the normal, restoring force applied to the wiper element by the biasing mechanism 104. In contrast, for a flexible wiper element, the wiping force may be a function of the interference between the wiper element and the printhead, which may in turn be a function of wiper height and stiffness. The preload force may therefore be used to adjust the height of the wiper element 102 above the casing 110 in order to control the wiping force generated by the wiper element 102.

The position of the actuator 106 can be controlled using the controller 108. The controller 108 may set the position of the actuator 106 so as to provide a predetermined preload and thus wiping force for the cleaning operation. In the example shown in FIGS. 1 and 2, the wiping force applied by the wiper element 102 is larger when the biasing mechanism 104 is compressed by the actuator 106. A larger wiping force may be used for certain cleaning operations, whereas a smaller wiping force may be used for other cleaning operations.

Figure 3:
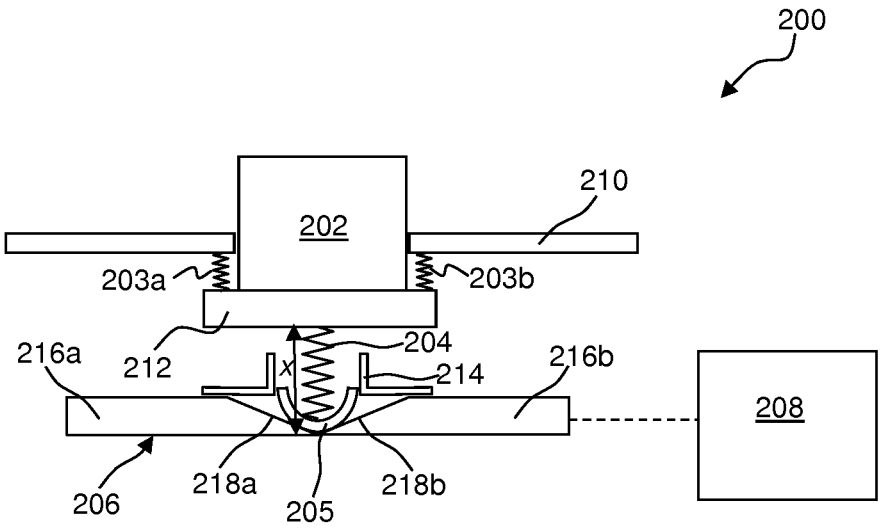
FIG. 3 is an example schematic view of another example printhead-wiping device in a first configuration.

FIG. 3 is a schematic representation of another example of a printhead-wiping device 200. As with the printhead-wiping device 100, the printhead-wiping device 200 comprises a wiper element 202 which may be in the form of a wiper blade. In this example, the wiper element 202 is connected to the casing 210 via a pair of stabilizing springs 203*a*, 203*b* which are disposed between the base portion 212 and the casing 210.

In the printhead-wiping device 200, the biasing mechanism is in the form of a spring 204. The spring is disposed between the base portion 212 of the wiper element 202 and a guide rail 205. In this example, the guide rail 205 has a curved outer surface. Specifically, the guide rail 205 has a U-shaped cross-section. The guide rail 205 is disposed within a guide channel formed in a guide plate 214. The guide plate 214 may be formed to guide movement of the biasing element 204. For example, the guide plate 214 may be shaped to constrain the biasing element 204 to linear movement. In the example shown, the guide channel provides parallel surfaces which ensure that the guide rail 205 moves linearly.

The spring 204 biases the wiper element 202 outwardly towards the printhead. The biasing mechanism 204 is again supported by an actuator 206 which is in communication with a controller 208.

In this example, the actuator 206 comprises a pair of sled portions 216*a*, 216*b* which are slidable relative to one another. Each sled portion 216*a*, 216*b* comprises a ramp 218*a*, 218*b* having an inclined surface. The ramps 218*a*, 218*b* of each of the sled portions 216*a*, 216*b* oppose one another, but are offset from one another, as is shown more clearly in FIGS. 5 to 7 which will be described below.

Figure 4:
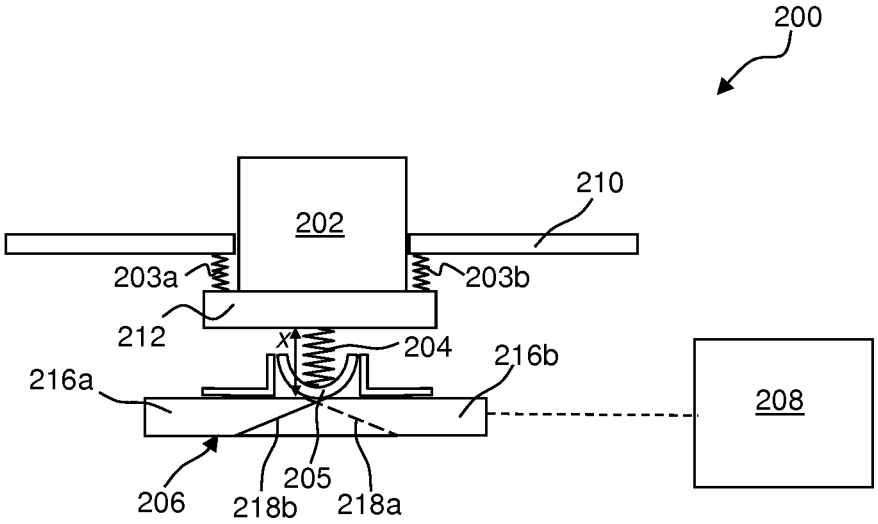
FIG. 4 shows the printhead-wiping device of FIG. 3 in a second configuration.

As described previously, the sled portions 216*a*, 216*b* are slidably translatable toward and away from one another between a first configuration and a second configuration, as shown in FIGS. 3 and 4 respectively.

In the first configuration shown in FIG. 3, the sled portions 216*a*, 216*b* are retracted such that the ramps 218*a*,

218*b* are spaced from one another. The guide rail 205 is therefore allowed to sit between the ramps 218*a*, 218*b* at a minimum height.

As the actuator 206 transitions from the first configuration to the second configuration, the sled portions 216*a*, 216*b* are drawn towards one another such that the ramps 218*a*, 218*b* overlap one another. The ramps 218*a*, 218*b* are thus slid underneath the guide rail 205 forcing it through the guide channel formed in the guide plate 214 towards the wiper element 202. In the second configuration, the ramps 218*a*, 218*b* fully overlap such that the guide rail 205 is at a maximum height.

The movement of the actuator 206 from the first configuration to the second configuration reduces the distance between the guide rail 205 and the base portion 212 of the wiper element 202. Consequently, the spring 204 is compressed, reducing its axial length x and generating a preload force within the spring 204. As described previously for the printhead-wiper device 100, this preload force dictates a wiping force applied by the wiper element 202 against the printhead during the cleaning operation and thus the controller 208 can be used to set the position of the actuator 206 so as to provide a predetermined preload and thus wiping force for the cleaning operation.

The ramps 218*a*, 218*b* of the sled portions 216*a*, 216*b* convert the movement of the sled portions 216*a*, 216*b* in a first direction into a compression of the spring 204 in a second direction which is perpendicular to the first direction. The opposed sled portions 216*a*, 216*b* provide even movement of the guide rail 205; however, in other examples, a single sled portion may be used to raise and lower the guide rail 205. The or each ramp may be inserted between the biasing mechanism and a support surface so as to progressively space the biasing mechanism from the support surface.

Figure 5:
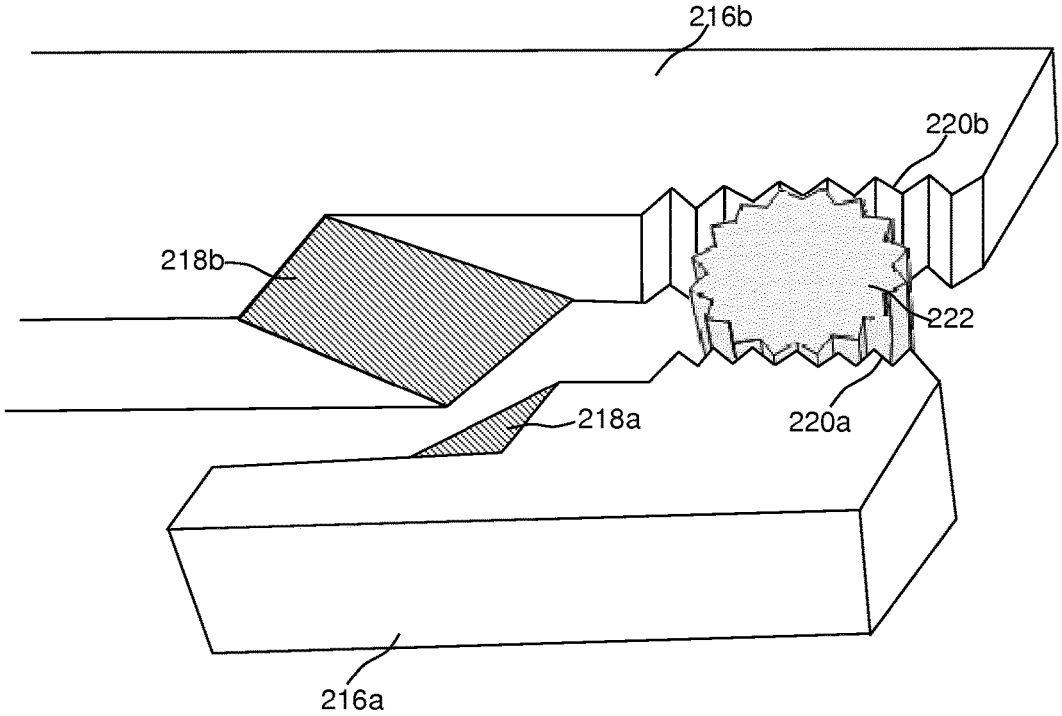
FIG. 5 is a perspective view of an example of an actuator for the printhead-wiping device shown in FIG. 3.
Figure 6:
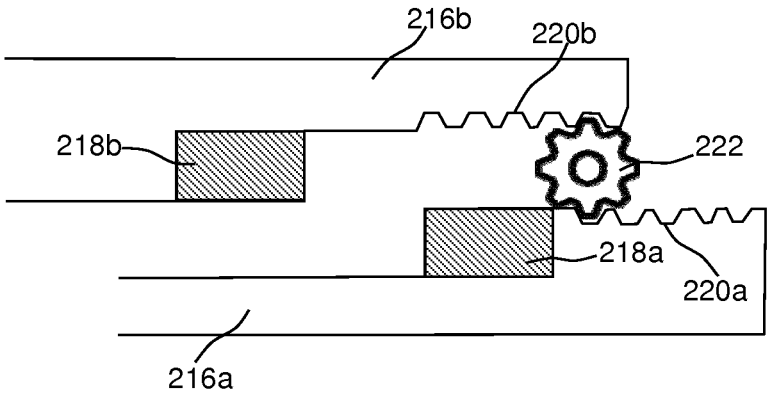
FIG. 6 is a plan view of the actuator shown in FIG. 5 in a first configuration.
Figure 7:
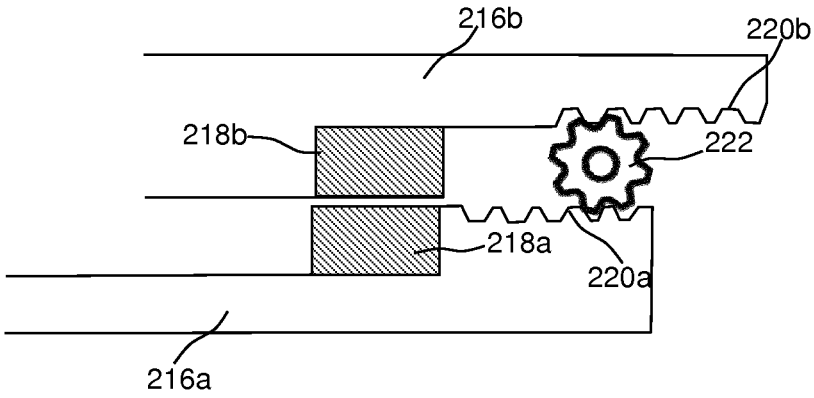
FIG. 7 is a plan view of the actuator shown in FIG. 5 in a second configuration.

FIGS. 5 to 7 show an example of a mechanism for translating the sled portions 216*a*, 216*b* relative to one another which uses a rack and pinion gearing arrangement.

Specifically, as shown, each of the sled portions 216*a*, 216*b* comprises a rack gear 220*a*, 220*b* which are arranged such that they oppose one another. A pinion gear 222 is disposed between and engages with the rack gears 220*a*, 220*b*. Rotation of the pinion gear 222 thus causes translation of the sled portions 216*a*, 216*b* in opposite direction.

FIG. 6 shows the sled portions 216*a*, 216*b* in the first configuration where the ramps 218*a*, 218*b* are spaced from one another. The actuator 206 transitions from the first configuration to the second configuration by rotating the pinion gear 222 in a clockwise direction. This causes the sled portions 216*a*, 216*b* to be drawn together such that the ramps 218*a*, 218*b* overlap fully, as shown in FIG. 7. It will be appreciated that the pinion gear 222 may be rotated such that the ramps 218*a*, 218*b* assume any position in-between the first and second configurations and that the limits of movement defined in the first and second configurations may differ from that shown and described above.

Figure 8:
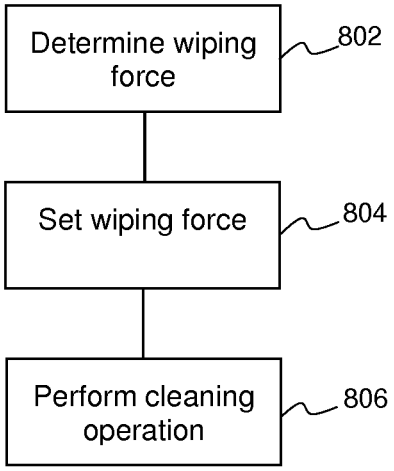
FIG. 8 is a flowchart showing an example method.

FIG. 8 shows a flowchart of an example method which may be performed using a printhead-wiping device, such as those described previously, for example. In block 802, the wiping force to be applied by the wiper element during a cleaning operation is determined. The wiping force may be determined based on the printhead to be cleaned. For example, the wiping force may be determined based on the type of printhead being cleaned. For example, the print fluid delivered by the printhead may determine the wiping force to be used for the printhead. As an example, the pigmented ink delivered by a monochrome printhead may dry more quickly than the dye-based ink of a colour printhead such that a larger wiping force is used for the monochrome printhead. Wiping forces may also be determined for other print fluids such as primers, fixers, varnishes, etc. Further, the wiping force may be determined based on the cleaning operation to be performed on the printhead. For example, it may be desirable to perform wipes with a lower wiping force when doing frequent while-printing wipes, whereas a wipe with a higher wiping force may be used when performing a recovery routine to remove dry ink from clogged nozzles. This may be particularly useful for 3D printers, where a large force may be needed to remove 3D powder stuck on a nozzle plate of the printhead during a recovery routine. The duty cycle or frequency of the cleaning operation may therefore be used to determine the wiping force needed. The duty cycle and wiping force may be controlled to vary inversely such that at higher duty cycles (i.e. more frequent use), lower wiping forces are used and vice versa. For example, a lookup table of duty cycle and wiping force values may be provided for this purpose or the wiping force may be predetermined for each form of cleaning operation. The wiping force may also be a function of other variables, such as: nozzle health, printhead age, ink usage, printhead cartridge temperature, etc.

In block 804, the wiping force is set for the printhead-wiping device. As described previously, this is achieved by controlling the actuator so as to adjust the preload force of the biasing mechanism coupled to the wiper element. The preload force is set such that the biasing mechanism biases the wiper element towards the printhead at the necessary wiping force. For example, in the example of FIG. 3, the sled portions 216*a*, 216*b* may be positioned to provide the desired degree of overlap (including no overlap) between the ramps 218*a*, 218*b* so as to position the guide rail 205 at the necessary height and to compress the spring 204 at the set preload force to achieve the necessary wiping force.

In block 806, the cleaning operation is performed by moving the printhead relative to the wiper element so that the wiper element is drawn across the printhead.

This process may be repeated such that the method returns to block 802. The method may return to block 802 after every N events, where an event may be a unit of time, print passes, or any other suitable measure for determining whether the printhead should be cleaned.

It will be appreciated that the elements of the printhead-wiping devices 100, 200 described previously may be integrated into a print device having a printhead for performing a printing operation. The features of the controller 108, 208 may be integrated into the controller of the print device or may be provided as a standalone controller. The print device may be any ink-based printer, such as a regular inkjet printer, or a 3D printer.

The examples described previously allow the wiping force applied by the wiping element to be controlled by actuation of the actuator. The wiping force can therefore be tailored to the specific conditions. This may allow, for example, the wiping force to be minimized, resulting in reduced fatigue of components. This may be particularly beneficial in heated print surfaces, such as in 3D printing, where heat can accelerate fatigue, for example. Higher wiping forces can also be used during recovery routines, for example, reducing the number of wipes needed to clear dry ink and thus, for example, improving recovery times and printhead productivity. Allowing a higher wiping force to be used also may, for example, reduce the probability of a user having to remove the print head from the carriage and clean the nozzle plate manually. Vibration of the printhead may also be, for example, reduced at the beginning and end of a wipe, which can create bubbles inside nozzles, potentially leading to image quality artefacts.

The biasing mechanism may take on various forms and is not limited to the example of a spring given herein. In particular, the biasing mechanism may comprise a piston, elastomer or other resiliently compressible element.

The actuator may take on various forms and is not limited to the examples given.

The present disclosure can be provided as methods, systems or machine readable instructions, such as hardware or any combination of software and hardware (e.g., firmware), or the like. Such machine readable instructions may be included on a computer readable storage medium (including but is not limited to disc storage, CD-ROM, optical storage, etc.) having computer readable program codes therein or thereon.

The present disclosure is described with reference to a flow chart according to an example of the present disclosure. Although the flow diagrams described above show a specific order of execution, the order of execution may differ from that which is depicted. It shall be understood that each block in the flow charts, as well as combinations of the blocks in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (for example, the controller 104, 504) may be implemented by a processor executing machine readable instructions stored in a memory, or a processor operating in accordance with instructions embedded in logic circuitry. The term 'processor' is to be interpreted broadly to include a Central Processing Unit (CPU), processing unit, Application-specific integrated circuit (ASIC), logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by block(s) in the flow charts.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It should be noted that the above-mentioned examples illustrate rather than limit what is described herein, and many implementations may be designed without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A printhead-wiping device comprising:

a wiper element;

a biasing mechanism coupled to the wiper element, the biasing mechanism to bias the wiper element towards a printhead;

an actuator coupled to the biasing mechanism, the actuator to adjust a preload force applied to the biasing mechanism; and a controller to actuate the actuator so as to adjust the preload force and thereby control a wiping force applied by the wiper element against the printhead.

2. A printhead-wiping device in accordance with claim 1, wherein the biasing mechanism comprises a spring and wherein the actuator compresses the spring to adjust the preload force applied to the spring.

3. A printhead-wiping device in accordance with claim 1, wherein the actuator comprises a ramp which is to be inserted between the biasing mechanism and a support surface so as to progressively space the biasing mechanism from the support surface.

4. A printhead-wiping device in accordance with claim 1, wherein the actuator comprises a pair of opposed ramps which are to be inserted between the biasing mechanism and a support surface so as to progressively space the biasing mechanism from the support surface.

5. A printhead-wiping device in accordance with claim 4, wherein each ramp comprises a rack gear and a pinion gear is disposed between the rack gears of the ramps such that rotation of the pinion gear causes the ramps to move toward or away from one another.

6. A printhead-wiping device in accordance with claim 4, wherein the ramps are positioned in a first configuration when a first preload force is set and are positioned in a second configuration when a second preload force is set.

7. A printhead-wiping device in accordance with claim 4, comprising a guide plate formed to guide movement of the biasing mechanism.

8. A printhead-wiping device in accordance with claim 4, wherein the biasing mechanism comprises a guide rail having a curved outer surface.

9. A printhead-wiping device in accordance with claim 1, wherein the controller controls the wiping force such that different wiping forces are applied for different cleaning operations.

10. A printhead-wiping device in accordance with claim 9, wherein the wiping force is determined based on a duty cycle of a cleaning operation and/or a print fluid supplied by the printhead to be cleaned.

11. A printhead-wiping device in accordance with claim 10, wherein the wiping force and duty cycle are controlled so as to vary inversely.

12. A printhead-wiping device in accordance with claim 1, further comprising:

a casing through which the wiper element extends towards the printhead; and a stabilizing spring disposed between an underside of the casing and a base portion on which the wiper element is supported, the biasing mechanism connected to the base portion to bias the wiper element towards the printhead.

13. A printhead-wiping device in accordance with claim 12, further comprising two stabilizing springs, one on either side of the wiper element.

14. A printhead-wiping device in accordance with claim 1, further comprising a guide plate comprising sides around the biasing mechanism to guide linear movement of the biasing mechanism.

15. A printhead-wiping device in accordance with claim 14, the biasing mechanism extending through the guide plate between a base portion of the wiper element and a curved guide rail in which a lower end of the biasing mechanism is received.

16. A printhead-wiping device in accordance with claim 15, wherein the actuator comprises a ramp slidable below the guide rail to raise and lower the guide rail so as to adjust the preload force.

17. A print device comprising:

a printhead to perform a printing operation;

a wiper element to clean the printhead;

a biasing mechanism coupled to the wiper element, the biasing mechanism to bias the wiper element towards the printhead;

an actuator coupled to the biasing mechanism, the actuator to adjust a preload force applied to the biasing mechanism; and a controller to move the printhead relative to the wiper element such that the wiper element is drawn across the printhead, wherein the controller actuates the actuator so as to adjust the preload force and thereby control a wiping force applied by the wiper element against the printhead.

18. A method comprising:

determining a wiping force to be applied by a wiper element against a printhead during a cleaning operation, the wiping force being determined based on the cleaning operation;

setting the wiping force by adjusting a preload force applied to a biasing mechanism coupled to the wiper element; wherein the preload force is set such that the biasing mechanism biases the wiper element towards the printhead at the determined wiping force; and executing the cleaning operation by moving the printhead relative to the wiper element so that the wiper element is drawn across the printhead.

19. A method in accordance with claim 18, wherein the wiping forced is determined based on a duty cycle of a cleaning operation and/or a print fluid supplied by the printhead to be cleaned.

20. A non-transitory machine readable medium comprising instructions, which, when executed by a controller, cause a print device to determine a wiping force to be applied by a wiper element against a printhead during a cleaning operation, the wiping force being determined based on the cleaning operation;

set the wiping force by adjusting a preload force applied to a biasing mechanism coupled to the wiper element; wherein the preload force is set such that the biasing mechanism biases the wiper element towards the printhead at the determined wiping force; and execute the cleaning operation by moving the printhead relative to the wiper element so that the wiper element is drawn across the printhead.

* * * * *